US008907589B2

(12) United States Patent
Mills et al.

(10) Patent No.: US 8,907,589 B2
(45) Date of Patent: Dec. 9, 2014

(54) METHOD AND APPARATUS FOR OPERATING A GROUP OF LIGHTING FIXTURE NODES

(75) Inventors: George Bradley Mills, Westford, MA (US); Michael William Johnson, Groveland, MA (US); Bradford Thomas Kolsky, Woburn, MA (US)

(73) Assignee: Koninklijke Philips N.V., Eindhoven (NL)

( * ) Notice: Subject to any disclaimer, the term of this patent is extended or adjusted under 35 U.S.C. 154(b) by 95 days.

(21) Appl. No.: 13/820,002

(22) PCT Filed: Sep. 3, 2011

(86) PCT No.: PCT/IB2011/053860

§ 371 (c)(1),
(2), (4) Date: Feb. 28, 2013

(87) PCT Pub. No.: WO2012/029053

PCT Pub. Date: Mar. 8, 2012

(65) Prior Publication Data

US 2013/0154513 A1 Jun. 20, 2013

Related U.S. Application Data

(60) Provisional application No. 61/379,746, filed on Sep. 3, 2010.

(51) Int. Cl.

| | |
|---|---|
| ***H05B 37/02*** | (2006.01) |
| ***H05B 37/00*** | (2006.01) |
| ***H05B 33/08*** | (2006.01) |

(52) U.S. Cl.

CPC ..... *H05B 37/02* (2013.01); *H05B 37/0254* (2013.01); *H05B 33/0848* (2013.01); *H05B 33/0866* (2013.01); *H05B 37/0245* (2013.01)

USPC ..... 315/297; 315/312

(58) Field of Classification Search

CPC ..... H05B 37/02; H05B 33/08; H05B 41/00; F21Y 210/00; F21S 4/001; F21S 4/00; H05K 23/00

USPC ..... 315/312, 185 R, 185 S, 307, 224, 297, 315/315, 317–319, 321, 324

See application file for complete search history.

(56) References Cited

U.S. PATENT DOCUMENTS

2002/0047648 A1* 4/2002 Belliveau ..... 315/312
2002/0171379 A1 11/2002 Adamson (Continued)

FOREIGN PATENT DOCUMENTS

WO 2007003038 A1 1/2007
WO 2010056112 A1 5/2010

*Primary Examiner* — Minh D A
(74) *Attorney, Agent, or Firm* — Meenakshy Chakravorty

(57) ABSTRACT

Methods and apparatus for operating a group of lighting fixture nodes (10A-D) at a reduced power level are disclosed. In some versions of the methods a plurality of lighting fixture nodes in a group of electrically connected lighting fixture nodes may each be operated at a nominal fixture power level; a current draw across at least a test lighting fixture node of the lighting fixture nodes may be identified; and the extent to which to reduce power of each lighting fixture node may be determined as a function of the current draw across the test lighting fixture node.

21 Claims, 3 Drawing Sheets

(56) References Cited

U.S. PATENT DOCUMENTS

| | | | | |
|---|---|---|---|---|
| 2003/0001523 | A1* | 1/2003 | Belliveau | 315/291 |
| 2004/0167732 | A1 | 8/2004 | Spitaels et al. | |
| 2005/0023996 | A1 | 2/2005 | Adamson et al. | |
| 2006/0193133 | A1 | 8/2006 | Von Der Brelie | |
| 2007/0145915 | A1 | 6/2007 | Roberge et al. | |
| 2008/0297068 | A1* | 12/2008 | Koren et al. | 315/297 |
| 2009/0021955 | A1* | 1/2009 | Kuang et al. | 362/479 |
| 2010/0039043 | A1 | 2/2010 | Wacknov et al. | |
| 2010/0072904 | A1 | 3/2010 | Eckel et al. | |

* cited by examiner

METHOD AND APPARATUS FOR OPERATING A GROUP OF LIGHTING FIXTURE NODES

TECHNICAL FIELD

The present invention is directed generally to a method and apparatus for operating a group of lighting fixture nodes. More particularly, various inventive methods and apparatus disclosed herein relate to selectively operating a group of lighting fixture nodes at a reduced power level to prevent overloading of a power circuit and/or overloading of one or more lighting fixture nodes in the group of lighting fixture nodes.

BACKGROUND

A lighting fixture node includes at least one lighting fixture having at least one light source and at least one driver/ballast driving the light source. Sometimes the lighting fixture node contains only a single lighting fixture. A group of lighting fixture nodes are sometimes electrically connected to one another in order to share power from a power circuit among the group of lighting fixture nodes. For example, a first lighting fixture node may be electrically connected to an AC power circuit, a second lighting fixture node may be electrically connected to the first lighting fixture node, and a third lighting fixture node may be electrically connected to the second lighting fixture node. The first lighting fixture node may utilize power from the AC power circuit and may also route power to the second lighting fixture node. The second lighting fixture node may utilize power routed to it from the first lighting fixture node and may also route power to the third lighting fixture node. Such groupable and electrically connectable lighting fixture nodes may be utilized in various markets and locations. For example, such lighting fixture nodes may be utilized in the touring and rental markets to help stage events at various venues.

When in use, each lighting fixture node in a group of lighting fixture nodes consumes a certain amount of power. The amount of power consumed may remain substantially constant over time or may vary depending on, inter alia, the currently selected light output characteristics of the lighting fixture node (e.g., light output intensity and/or light output color). When a group of lighting fixture nodes are electrically connected to one another in order to share power from a power circuit, there is a possibility that the collective power consumption of the group of lighting fixture nodes will exceed the capabilities of the power circuit. If the collective power consumption of the group of lighting fixture nodes exceeds the capabilities of the power circuit it may cause a circuit breaker associated with the power circuit to be tripped, may cause a fuse associated with the power circuit to blow, and/or may cause other undesirable and/or dangerous events to occur.

Also, when a group of lighting fixture nodes are electrically connected to one another in order to share power from a power circuit, there is a possibility that the collective power consumption of a plurality of lighting fixture nodes in the group of lighting fixture nodes will exceed the electrical capabilities of one or more lighting fixture nodes in the group of lighting fixture nodes. For example, there is a possibility that a first lighting fixture node is connected directly to a power circuit, that the first lighting fixture node supplies power (directly or indirectly) to a plurality of downstream lighting fixture nodes, and that the collective power consumption of the downstream lighting fixture nodes exceeds the electrical capabilities of the first lighting fixture node. If the collective power consumption of the group of lighting fixture nodes exceeds the capabilities of one or more lighting fixture nodes in the group of lighting fixture nodes it may cause a fuse of the lighting fixture node to blow, a breaker of the lighting fixture node to trip, wiring of the lighting fixture node to exceed its current rating, and/or may cause other undesirable and/or dangerous events to occur.

As described above, circuit breakers and/or fuses may be utilized in circuits that include a group of lighting fixture nodes electrically connected to one another in order to potentially prevent a dangerous situation from occurring. However, a tripped breaker and/or a blown fuse will cause a complete power interruption to the group of lighting fixture nodes. Such a power interruption is inconvenient (especially if it occurs during an event) and will require attention by an individual to reset the breaker and/or replace the fuse. Moreover, breakers and/or fuses may sometimes fail to function properly, may be incorrectly installed, and/or may not be provided in some settings.

Thus, there is a need in the art to provide a method and apparatus for selectively operating a group of lighting fixture nodes at a reduced power level in order to prevent overloading of a power circuit and/or overloading of one or more lighting fixture nodes in the group of lighting fixture nodes.

SUMMARY

The present disclosure is directed to inventive methods and apparatus for operating a group of lighting fixture nodes at a reduced power level. For example, in some methods in order to determine the extent to which to reduce the power of each lighting fixture node the following steps may be taken: a plurality of lighting fixture nodes in a group of electrically connected lighting fixture nodes may each be operated at a nominal fixture power level that is less than a maximum power level of a respective of the lighting fixture nodes; a current draw across at least a test lighting fixture node of the lighting fixture nodes may be identified; and the extent to which to reduce power of each lighting fixture node may be determined as a function of the current draw across the test lighting fixture node. In some versions of the method the extent to which to reduce power of each lighting fixture node may be determined as a function of the current draw across the test lighting fixture node and the nominal expected current draw across the test lighting fixture node. The sum of the power utilized by all of the lighting fixture nodes in the group may optionally selectively be bound by the maximum output of a power circuit and/or by the minimum of a maximum current draw capability among the lighting fixture nodes.

Generally, in one aspect, a method of selectively operating a group of networked and commonly powered lighting fixture nodes at reduced power is provided. Each of the networked lighting fixture nodes includes at least one controllable lighting fixture and the method includes the steps of electrically coupling a single lighting fixture node of the lighting fixture nodes to a power circuit having a power circuit maximum output; operating each of a plurality of the lighting fixture nodes at a nominal fixture power level, wherein each nominal fixture power level is less than a maximum power level of a respective of the lighting fixture nodes; identifying a current draw across at least a test lighting fixture node of the lighting fixture nodes being operated at the nominal fixture power level; determining a reduced power level for each of the lighting fixture nodes, wherein the reduced power level for each of the lighting fixture nodes is based at least on the current draw across the test fixture; and commanding each of the lighting fixture nodes to substantially operate at a respective reduced power level. When the lighting fixture nodes are each operating at their respective reduced power level, a substantially consistent optical output among the lighting fixture nodes is maintained. The sum of the reduced power level for all of the lighting fixture nodes is selectively bound based on the power circuit maximum output.

In some embodiments the method further includes the step of determining an expected nominal current draw for at least the test lighting fixture node. In some versions of those embodiments the reduced power level is additionally based on comparing the expected nominal current draw to the current draw.

In some embodiments the step of identifying the current draw across at least the test lighting fixture node further comprises individually identifying current draw across additional of the lighting fixture nodes. In some versions of those embodiments the method further includes the step of determining an expected nominal current draw for the additional of the lighting fixture nodes across which the current draw was identified.

In some embodiments the method further includes the step of identifying a minimum of a maximum current draw capability among the lighting fixture nodes. In some versions of those embodiments the reduced power level is selectively bound based on the minimum of the maximum current draw capability.

In some embodiments the reduced power level is based on proportional extrapolation of the current draw across the test lighting fixture node. In some versions of those embodiments the test lighting fixture node is directly electrically coupled to the power circuit.

Generally, in another aspect a method of selectively operating a group of networked and commonly powered lighting fixture nodes at reduced power is provided. Each of the networked lighting fixture nodes includes at least one controllable lighting fixture and the method includes the steps of electrically coupling a single lighting fixture node of the lighting fixture nodes to a power circuit having a power circuit maximum output; broadcasting a query fixture network topology command to all of the lighting fixture nodes, wherein each of the lighting fixture nodes sends a fixture query command to at least one of any downstream of the lighting fixture nodes after receipt of the query fixture network topology command; determining a master lighting fixture node of the lighting fixture nodes which did not receive any fixture query command; determining an expected nominal current of at least one fixture of the lighting fixture nodes; operating the one lighting fixture node and any of the lighting fixture nodes downstream from the one lighting fixture node at a nominal fixture power level that is less than a maximum power level of a respective of the lighting fixture nodes; identifying a current draw across at least the one lighting fixture node when the one lighting fixture node and any of the lighting fixture nodes downstream from the one lighting fixture node are being operated at the nominal fixture power level; reducing power consumption of at least some of the lighting fixture nodes based at least in part on comparing the expected nominal current draw to the current draw.

In some embodiments the step of reducing power consumption of at least some of the lighting fixture nodes includes reducing power consumption of at least some of the lighting fixture nodes such that a substantially consistent optical output is maintained therebetween. In some versions of those embodiments the step of reducing power consumption of at least some of the lighting fixture nodes comprises reducing power consumption of all of the lighting fixture nodes.

In some embodiments the one lighting fixture node is the master lighting fixture node.

In some embodiments each of the lighting fixture nodes sends the fixture query command to only an immediately downstream of the lighting fixture nodes upon receipt of the query fixture network topology command.

In some embodiments the step of determining an expected nominal current of at least the one lighting fixture node of the lighting fixture nodes comprises determining an expected nominal current of additional of the lighting fixture nodes and the step of identifying current draw across at least the one lighting fixture node further comprises individually identifying current draw across the additional of the lighting fixture nodes.

In some embodiments the method further includes the step of identifying a first separately powered lighting fixture node in a separate group of commonly networked but separately powered lighting fixture nodes by comparing the expected nominal current and the actual nominal current of the first separately powered lighting fixture node to the expected nominal current and the actual nominal current of at least one of the lighting fixture nodes.

In some embodiments the method further includes the step of identifying a minimum of a maximum current draw capability among the lighting fixture nodes and selectively bounding the reduced power level based on the minimum of the maximum current draw capability.

Generally, in another aspect a lighting fixture network is provided that includes a plurality of lighting fixture nodes in communication with one another. Each of the lighting fixture nodes includes at least one lighting fixture having at least one light source, at least one adjustable driver, a controller, a communications system, a power input, and a power output. The at least one adjustable driver drives the at least one light source at a selectively adjustable power level. The controller is in communication with the adjustable driver. The communication system is in communication with the controller and in communication with at least one other of the lighting fixture nodes. The power input receives power directly from at least one of other of the lighting fixture nodes and a power circuit. The power output selectively transmits power to at least one other of the lighting fixture nodes. Each controller is operable in a power level determination mode, wherein: each controller causes a corresponding driver to operate at a nominal fixture power level that is less than a maximum power level of the respective driver; and at least one controller selectively communicates expected current draw data to at least one other of the lighting fixture nodes and selectively communicates actual current draw data from operation in the power level determination mode to at least one other of the lighting fixture nodes. Each controller is also operable in a reduced power mode, wherein: each controller causes a corresponding driver to operate at a reduced power level that is based at least in part on comparing the expected nominal current draw to the current draw.

In some embodiments each of the controllers, when in the reduced power mode, causes a corresponding driver to drive a corresponding at least one light source such that a substantially consistent optical output among the lighting fixture nodes is maintained.

In some embodiments a plurality of the controllers, when in the power level determination mode, selectively communicate a respective expected current draw data to at least one other of the lighting fixture nodes and selectively communicate a respective actual current draw data to at least one other of the lighting fixture nodes. In some version of those embodiments each reduced power level is based at least in part on comparing a plurality of expected nominal current draw to a plurality of actual current draw.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
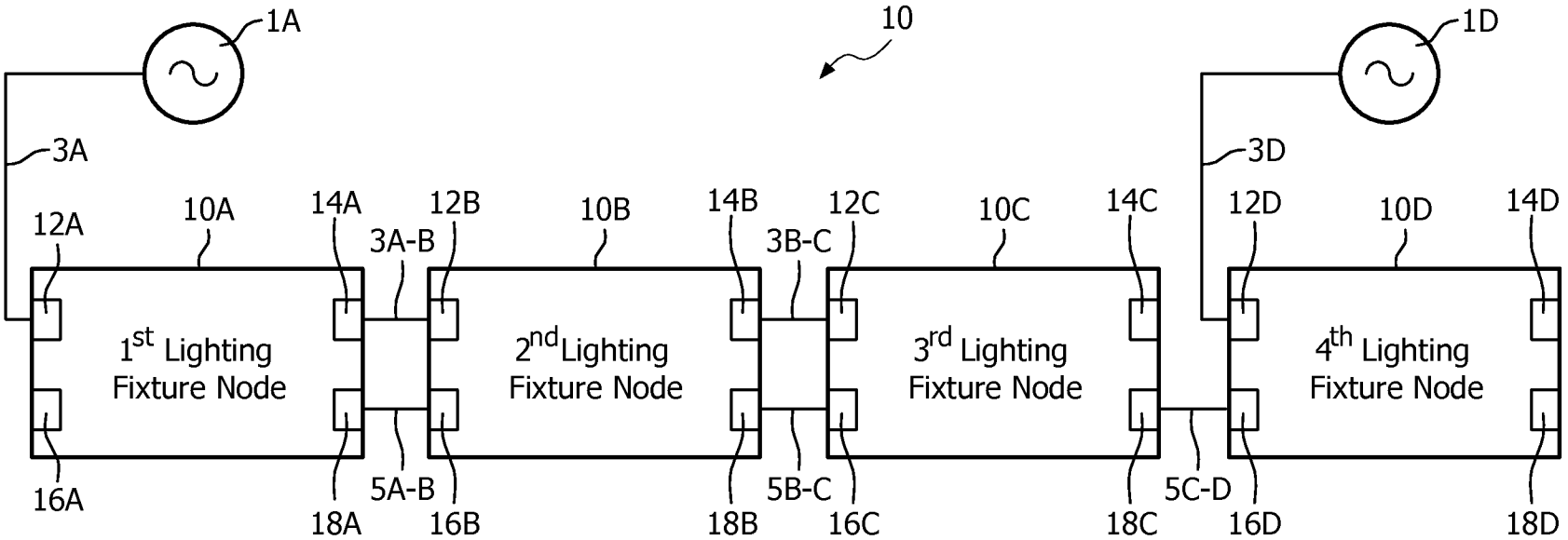
FIG. 1 illustrates four lighting fixture nodes; three of the lighting fixture nodes share power from a common power circuit through electrical power connections with each other; all four of the lighting fixture nodes are in network communication with one another.

When a group of lighting fixture nodes are electrically connected to one another in order to share power from a power circuit, there is a possibility that the collective power consumption of the group of lighting fixture nodes will exceed the capabilities of the power circuit. If the collective power consumption of the group of lighting fixture nodes exceeds the capabilities of the power circuit it may cause a circuit breaker associated with the power circuit to be tripped, may cause a fuse associated with the power circuit to blow, and/or may cause other undesirable and/or dangerous events to occur. Also, there is a possibility that the collective power consumption of a plurality of lighting fixture nodes in the group of lighting fixture nodes may additionally or alternatively exceed the electrical capabilities of one or more lighting fixture nodes in the group of lighting fixture nodes, thereby potentially causing a fuse of the lighting fixture node to blow, a breaker of the lighting fixture node to trip, wiring of the lighting fixture node to exceed its current rating, and/or other undesirable and/or dangerous events to occur. Although circuit breakers and/or fuses may be utilized in order to potentially prevent a dangerous situation from occurring, a tripped breaker and/or a blown fuse will cause a complete power interruption to the group of lighting fixture nodes. Such a power interruption is inconvenient and will require attention by an individual to reset the breaker and/or replace the fuse.

Thus, Applicants have recognized an appreciated that there is a need in the art to provide a method and apparatus for selectively operating a group of lighting fixture nodes at a reduced power level. Such a method and apparatus may prevent overloading of a power circuit and/or overloading of one or more lighting fixture nodes in the group of lighting fixture nodes, thereby potentially preventing the tripping of a breaker and/or blowing of a fuse.

More generally, Applicants have recognized and appreciated that it would be beneficial to provide a method and apparatus that selectively reduces the power consumption of at least some of a plurality of lighting fixture nodes in a group of lighting fixture nodes based on at least one measured characteristic across the group of lighting fixture nodes.

In view of the foregoing, various embodiments and implementations of the present invention are directed to a method for selectively reducing the power consumption of at least some of a plurality of lighting fixture nodes in a group of lighting fixture nodes. In some embodiments of the method, in order to determine the extent to which to reduce the power of each lighting fixture node the following steps may be taken: a plurality of lighting fixture nodes in a group of electrically connected lighting fixture nodes may each be operated at a nominal fixture power level that is less than a maximum power level of a respective of the lighting fixture nodes; a current draw across at least a test lighting fixture node of the lighting fixture nodes may be identified; and the extent to which to reduce power of each lighting fixture node may be determined as a function of the current draw across the test lighting fixture node. In some versions of the method the extent to which to reduce power of each lighting fixture node may be determined as a function of the current draw across the test lighting fixture node and the nominal expected current draw across the test lighting fixture node. The sum of the power utilized by all of the lighting fixture nodes in the group may optionally selectively be bound by the maximum output of a power circuit and/or by the minimum of a maximum current draw capability among the lighting fixture nodes.

Referring to FIG. 1, in one embodiment, a lighting fixture network 10 includes a group of networked and commonly powered lighting fixture nodes: first lighting fixture node 10A, second lighting fixture node 10B, and third lighting fixture node 10C. A lighting fixture node includes at least one lighting fixture having at least one light source and at least one driver/ballast driving the light source. Sometimes the lighting fixture node contains only a single lighting fixture.

The lighting fixture nodes 10A, 10B, and 10C are commonly powered by first AC power circuit 1A. In particular, first AC power circuit 1A is electrically coupled to a power input 12A of first lighting fixture node 10A via wiring 3A. A power output 14A of first lighting fixture node 10A is coupled to the power input 12A via internal wiring of the first lighting fixture node 10A and is electrically coupled to a power input 12B of second lighting fixture node 10B via wiring 3A-B. Optionally, the first lighting fixture node 10A may alter the power received from first AC power circuit 1A at power input 12A prior to the power being outputted at power output 14A. A power output 14B of second lighting fixture node 10B is coupled to the power input 12B via internal wiring of the first lighting fixture node 10A and is electrically coupled to a power input 12C of third lighting fixture node 10C via wiring 3B-C.

The lighting fixture nodes 10A and 10B are in network communication with one another via a connection 5A-B between a data transmitter 18A of first lighting fixture node 10A and a data receiver 16B of second lighting fixture node 10B. Similarly, lighting fixture nodes 10B and 10C are in network communication with one another via a connection 5B-C between a data transmitter 18B of second lighting fixture node 10B and a data receiver 16C of third lighting fixture node 10C. Optionally, a data receiver of a given lighting fixture node and a data transceiver of a given lighting fixture node may be combined as a data transceiver.

A fourth lighting fixture node 10D is in network communication with the lighting fixture nodes 10A, 10B, 10C, but is separately powered by a second AC power circuit 1D. The second AC power circuit 1D is electrically coupled to a power input 12D of the fourth lighting fixture node 10D via wiring 3D.

In some embodiments each lighting fixture node 10A-D may contain an end-to-end non-bus type network connection with any immediately upstream or downstream lighting fixture node 10A-D. Such end-to-end network connection may allow unambiguous communication between two adjacent lighting fixture nodes 10A-D. For example, first lighting fixture node 10A may be in an end-to-end connection with second lighting fixture node 10B and second lighting fixture node 10B may be in an end-to-end connection with first and third lighting fixture nodes 10A and 10C. In some embodiments ethernet and DMX may be used as the signaling protocols. Optionally, the second DMX channel may be configured to operate as a DMX repeater, thereby allowing end-to-end signaling between adjacent fixtures only. In other embodiments, a bus type network connection may be employed. In such embodiments each lighting fixture network 10A-D may optionally be individually addressable.

Data may be communicated between the various lighting fixture nodes 10A-D over any physical medium, including, for example, twisted pair coaxial cables, fiber optics, or a wireless link using, for example, infrared, microwave, or encoded visible light transmissions and any suitable transmitters, receivers or transceivers may be used to effectuate communication in the lighting fixture node network 10. Any suitable protocol may be used for data transmission, including, for example, TCP/IP, variations of Ethernet, Universal Serial Bus, Bluetooth, FireWire, Zigbee, DMX, 802.11b, 802.11a, 802.11g, token ring, a token bus, serial bus, power line networking over mains or low voltage power lines, or any other suitable wireless or wired protocol. The lighting fixture node network 10 may also use combinations of physical media and/or data protocols.

Figure 2:
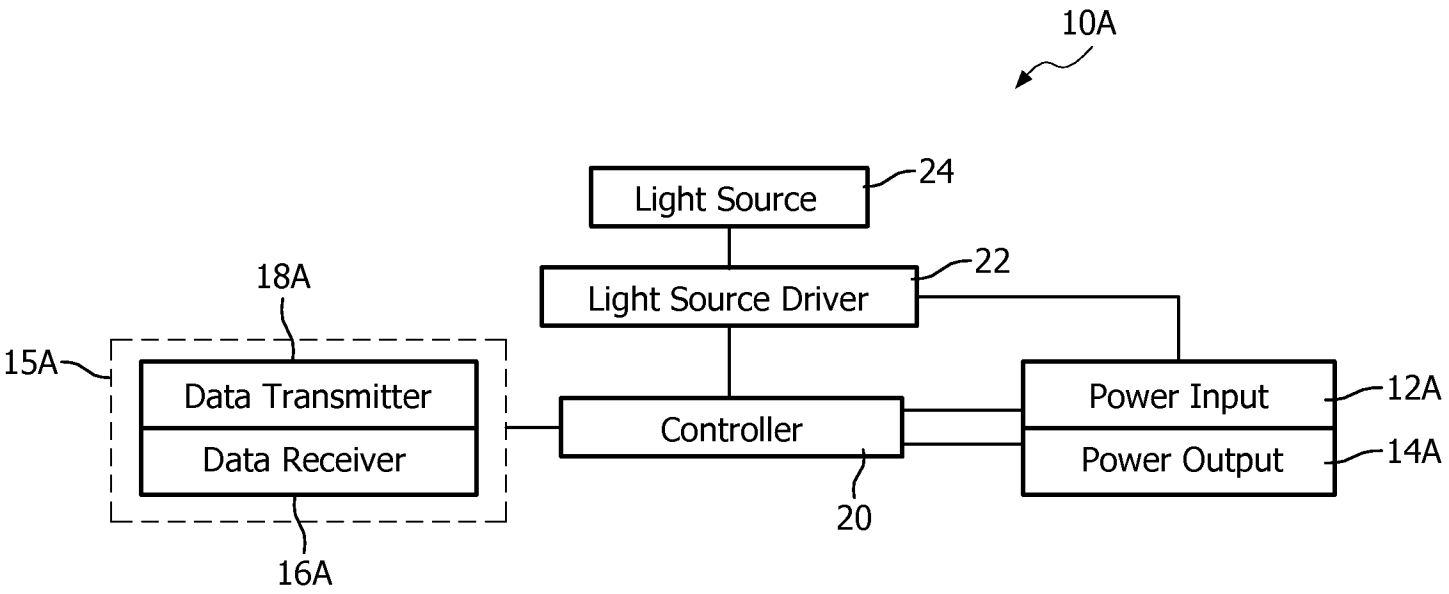
FIG. 2 illustrates one of the lighting fixture nodes of FIG. 1.

Referring to FIG. 2, the first lighting fixture node 10A of FIG. 1 is shown in additional detail. First lighting fixture node 10A includes a controller 20 in electrical communication with a communications system 15A, which includes the data receiver 16A and the data transmitter 18A. The controller 20 is also in electrical communication with the power input 12A, the power output 14A, and a light source driver 22. The light source driver 22 is in electrical powercommunication with the power input 12A and drives light source 24. In some embodiments the driver 22 may be an LED driver and light source 24 may be a LED-based light source and may optionally include a plurality of LEDs of different colors. In other embodiments the light source driver 22 may be a HID driver and the light source 24 may be a HID light source. The light source driver 22 is adjustable and adjustably drives light source 24 as directed by controller 20 to thereby achieve a desired light output from light source 24. For example, the controller 20 may direct the light source driver 22 to vary one or more light output characteristics of the light source 24 such as, for example, intensity and/or color. The controller 20 may alter the light output characteristics as part of inter alia, a light show, in response to a user actuated adjustment, and/or in order to reduce the power output of the first lighting fixture node 10A as described in additional detail herein.

The controller 20 is also configured to measure one or more values indicative of the actual current draw of first lighting fixture node 10A. The actual current draw of the first lighting fixture node 10A is the current consumed by the first lighting fixture node 10A itself in addition to the power being consumed by any downstream lighting fixture nodes that have a power connection to the lighting fixture node 10A (e.g., second lighting fixture node 10B and/or third lighting fixture node 10C). The controller 20 may be configured to measure the actual current draw of the first lighting fixture node 10A by measuring one or more voltage characteristics at the power input 12A and/or power output 14A, may be electrically coupled to a separate device that measures the actual current draw, or may otherwise measure the actual current draw and/or obtain signals indicative of the actual current draw.

The first lighting fixture node 10A comprises a single lighting fixture. In some embodiments the first lighting fixture node 10A may optionally include one or more additional components such as, for example, a cooling fan, heat dissipating structure, a housing, an on/off switch, and/or an additional lighting fixture (e.g., an additional driver and light source). In some embodiments the first lighting fixture node 10A may be a single lighting fixture. In some embodiments the first lighting fixture node 10A may be a ColorBlaze TRX lighting fixture available from Philips Color Kinetics and having a controller configured according to one or more aspects of the methods and apparatus described herein. In some embodiments the other lighting fixture nodes 10B, 10C, and 10D of FIG. 1 may share a substantially similar configuration with the first lighting fixture node 10A. In other embodiments one or more of the other lighting fixture nodes 10B, 10C, and 10D of FIG. 1 may have a unique configuration. For example, in some embodiments one or more of the lighting fixture nodes 10B, 10C, and 10D may contain multiple lighting fixtures optionally commonly controlled by a single controller. Also, for example, in some embodiments one or more of the lighting fixture nodes 10B, 10C, and 10D may contain a distinct light source, driver, and/or controller configuration.

Figure 3:
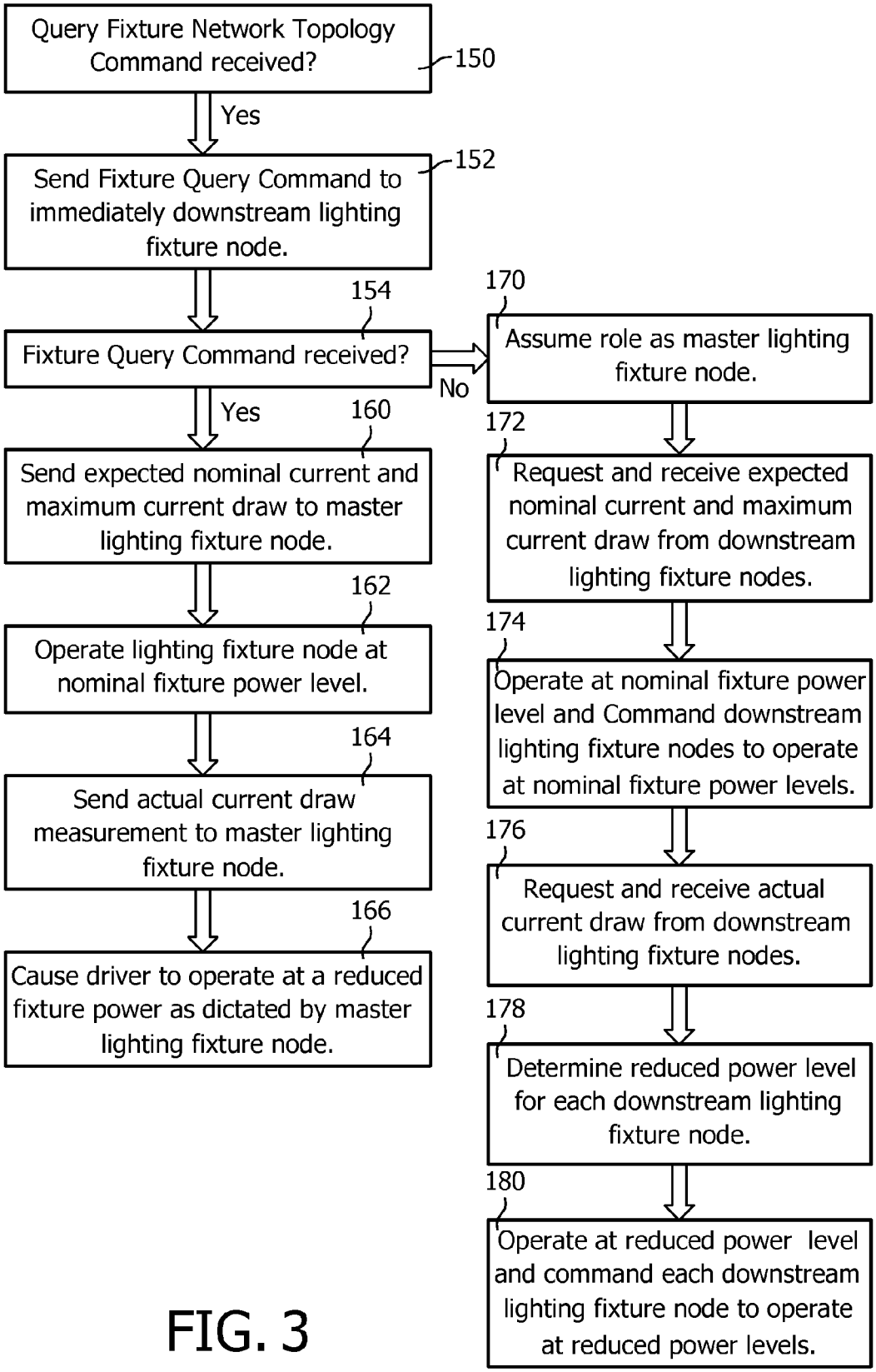
FIG. 3 illustrates an embodiment of part of the generalized logic of the controller of the lighting fixture node of FIG. 2.

FIG. 3 illustrates an embodiment of part of the generalized logic of the controller 20 of the first lighting fixture node 10A. Optionally, the controller of each of the other lighting fixture nodes 10B, 10C, and 10D may contain similar generalized logic. At step 150 the controller 20 monitors for a Query Fixture Network Topology Command A Query Fixture Network Topology Command may be issued by any of the lighting fixture nodes 10A-D. The Query Fixture Network Topology Command may be issued in response to a predetermined event (e.g., initial power up of one or more of the lighting fixture nodes 10A-D, and/or when power load across one or more of the lighting fixture nodes 10A-10D changes by a threshold amount) and/or in response to a user initiated event (e.g., actuation of a switch or other user interface optionally integrated with one or more of the lighting fixtures of the lighting fixture network 10). The Query Fixture Network Topology Command may also be reissued in response to additional lighting fixture nodes being powered on at a later time and/or lighting fixture nodes being added to the network 10.

After receiving the Query Fixture Network Topology Command, at step 152 the controller 20 sends a Fixture Query Command to at least the lighting fixture node directly connected to its data transmitter 18A. For example, the first lighting fixture node 10A would send the Fixture Query Command to at least the second lighting fixture node 10B. The Fixture Query Command may be sent by the lighting fixture node 10A within an amount of time after receipt of the Query Fixture Network Topology Command.

At step 154 the controller 20 waits for a Fixture Query Command to be received from an upstream lighting fixture node. The controller 20 may wait for the Fixture Query Command to be received prior to, simultaneous with, or after sending its own Fixture Query Command in step 152. If a Fixture Query Command is not received by the controller 20 within a predetermined amount of time of the Query Network Topology Command being received, then the controller 20 will proceed to step 170 and assume a role as a master lighting fixture node. If, on the other hand, a Fixture Query Command is received by the controller 20 within a predetermined amount of time of the Query Network Topology Command being received, then the controller 20 will assume a role as a slave lighting fixture and will proceed to step 160.

In the configuration of network 10 of FIG. 1, first lighting fixture node 10A will not receive a Fixture Query Command since there are no lighting fixture nodes upstream to issue the command. Accordingly, first lighting fixture node 10A will assume the role as the master lighting fixture node 10A in the configuration of network 10 in FIG. 1. The first lighting fixture node 10A will then send identify and configure commands to the downstream lighting fixture nodes 10A-10D to thereby determine the number of downstream lighting fixture nodes on the network 10. Optionally, the first lighting fixture node 10A may sequentially send identify and configure commands to lighting fixture nodes 10B-10D and sequentially receive responses from lighting fixture nodes 10B-10D to thereby determine ordering of the lighting fixture nodes 10A-10D. For example, the lighting fixture nodes 10A-10D may be in end-to-end communication with one another and the first lighting fixture node 10A may first send an identify and configure command to second lighting fixture node 10B, which then sends identification data back to first lighting fixture node 10A, before forwarding the identify and configure command to third lighting fixture node 10C. Accordingly, in such embodiments first lighting fixture node 10A will know how far downstream each lighting fixture node 10B-D is based on the sequential order in which responses to the identify and configure command are received.

At step 172, the controller 20 requests and receives expected nominal current values from each of the downstream lighting fixture nodes 10B-D. The expected nominal current value of each lighting fixture node is indicative of the expected current consumed by that lighting fixture node only (not including current draw from any downstream lighting fixture nodes) when one or more drivers thereof are operating at a nominal power level that is less than a maximum power level of the driver(s). In some embodiments each lighting fixture node may only have one expected nominal current value and only one nominal power level. In other embodiments the controller 20 of the master lighting fixture node may direct downstream lighting fixture nodes 10A, 10B, 10C, and/or 10D to operate at a specific nominal power level and the respective lighting fixture node 10A, 10B, 10C, and/or 10D may determine (e.g., via one or more reference tables and/or one or more formulas) a corresponding expected nominal current value.

At step 172, the controller 20 also optionally requests and receives maximum current draw values from each of downstream lighting fixture nodes 10A-D. The maximum current draw value is indicative of the maximum power load that can safely be handled by the lighting fixture node. The maximum current draw value may be based on inter alia, fuse ratings and/or the maximum current rating of wiring of the respective lighting fixture node 10A, 10B, 10C, and/or 10D. At step 172, the controller 20 also optionally requests and receives a maximum power level value from each of the downstream lighting fixture nodes 10A-D. The maximum power level value is indicative of the maximum amount of current that will be consumed by the respective lighting fixture node 10A-D only (not including current draw from any downstream lighting fixture nodes) when the respective lighting fixture node 10A-D is operated at the maximum power level.

At step 174, the controller 20 commands downstream lighting fixture nodes 10B-D to operate at their respective nominal fixture power level. The controller 20 also causes first lighting fixture node 10A to be operated at a nominal fixture power level. In some embodiments each of the lighting fixture nodes 10A-10D may be commanded to substantially similar nominal fixture power levels. In other embodiments one or more of the lighting fixture nodes 10A-10D may be commanded to a unique nominal fixture power level.

At step 176, the controller 20 requests and receives an actual current draw value from each of downstream lighting fixture nodes 10B-D. The controller 20 also obtains an actual current draw value for first lighting fixture node 10A. Optionally, the controller 20 may request and receive the actual current draw value from the lighting fixture nodes 10A-D in sequential order. As described herein, the actual current draw value of each of the lighting fixtures 10A-10D is the current consumed by the respective lighting fixture node 10A-D in addition to the power being consumed by any downstream lighting fixture nodes 10A-D that have a power connection thereto. For example, the first lighting fixture node 10A will have the highest actual current draw value, as it is supplying power to second and third lighting fixture nodes 10B and 10C. When each of the lighting fixtures 10A-10D are being operated at a substantially similar nominal fixture power level, the first lighting fixture node 10A will have an actual current draw value that measures approximately three times the expected nominal current for first lighting fixture node 10A. When each of the lighting fixtures 10A-10D are being operated at a substantially similar nominal fixture power level, the second lighting fixture node 10B will have an actual current draw value that measures approximately two times the expected nominal current for the second lighting fixture node 10B and the third lighting fixture node 10C will have an actual current draw value that is approximately equal to the expected nominal current for third lighting fixture node 10C.

Based on one or more comparisons of expected nominal current to actual current draw, the controller 20 may recognize that the third lighting fixture node 10C is the last lighting fixture node powered by the first power circuit 1A. For example, if topology of the lighting fixture network 10 is ascertained, controller 20 may recognize third lighting fixture node 10C is the last node powered based on comparison of expected nominal current to actual current draw of the first, second, and/or third lighting fixture nodes 10A-C.

The fourth lighting fixture node 10D will also have an actual current draw value that is approximately equal to the expected nominal current since it is powered from the second power circuit 1D and does not power any downstream lighting fixture nodes. When network topology is ascertained, the controller 20 may recognize that the fourth lighting fixture node 10D is powered by a second power circuit since it is downstream of third lighting fixture node 10C. If additional networked lighting fixture nodes were connected downstream of the fourth lighting fixture node 10D (either commonly or not commonly powered with fourth lighting fixture node 10D), the controller 20 could similarly determine if those fixtures are powered by second power circuit 1D or if they are powered by a power circuit distinct from second power circuit 1D, based on, inter alia, comparisons of expected nominal current and actual current draw of fourth lighting fixture nodes 10D and/or of other downstream lighting fixture nodes.

If necessary, at step 178, the controller 20 determines a reduced lighting fixture node power for one or more of first lighting fixture node 10A and downstream lighting fixture nodes 10B-10D. A reduced lighting fixture node power for one or more lighting fixture nodes 10A-D will be necessitated if the cumulative current consumption of the lighting fixture nodes 10A-D connected to a single power circuit exceeds the power capabilities of that single power circuit when such lighting fixture nodes 10A-D are being operated at the maximum power level. For example, if the first power circuit 1A has a maximum current rating of fifteen amps and the cumulative current consumption of the lighting fixture nodes 10A-C is greater than fifteen amps when operating at maximum power level, then it will be necessary to reduce the lighting fixture node power for one or more of the lighting fixture nodes 10A-C. The maximum current rating of the first power circuit 1A may be determined by a fixed value supplied to controller 20 or may be communicated to controller 20 via a user interface. Also, for example, if the second power circuit 1D has a maximum current rating of ten amps and the cumulative current consumption of the lighting fixture node 10D is greater than ten amps, then it will be necessary to reduce the lighting fixture node power for the lighting fixture node 10D.

A reduced power level will also be necessitated if the cumulative current consumption of lighting fixture nodes 10A-D downstream of a commonly powered single of lighting fixture nodes 10A-D exceeds the maximum current draw value of the single lighting fixture node when such downstream lighting fixture nodes 10A-D are being operated at maximum power. For example, if the first lighting fixture node 10A has a maximum current draw value of fifteen amps and the cumulative current consumption of the lighting fixture nodes 10B and 10C is greater than fifteen amps, then it will be necessary to reduce the lighting fixture node power for one or more of the lighting fixture nodes 10A, 10B and 10C. The maximum current draw value of the first lighting fixture node 10A may be determined by a fixed value supplied to controller 20 or may be communicated to controller 20 via a user interface.

If a reduced power level is necessary, it may be determined based on the actual current draw of one or more of the lighting fixture nodes 10A-D determined in step 176 and the expected nominal current draw of one or more of the lighting fixture nodes 10A-D determined in step 172. For example, as described herein, the controller 20 may determine that lighting fixture nodes 10A-C are commonly powered based on comparison of the expected nominal current values of one or more of the lighting fixture nodes 10A-D and the actual current draw values of the lighting fixture nodes 10A-D. In some embodiments the controller 20 may then analyze the actual current draw values of one or more of the lighting fixture nodes 10A-C to determine a reduced power level. For example, if the cumulative current draw of the lighting fixture nodes 10A-C when operating at nominal fixture power levels of approximately fifty percent of respective maximum power levels is approximately ten amps, the controller 20 may determine that each of the lighting fixture nodes 10A-C should operate at a reduced power level that is seventy-five percent or less of the maximum power level in order to prevent exceeding a fifteen amp rating of first power circuit 1A. In other embodiments the controller 20 may analyze the maximum power levels of one or more of the lighting fixture nodes 10A-C to determine a reduced power level. For example, if the cumulative maximum power levels of lighting fixture nodes 10A-C is approximately 20 amps, the controller 20 may determine that each of the lighting fixture nodes should operate at a reduced power level that is seventy-five percent or less of the maximum power level in order to prevent exceeding a fifteen amp rating of first power circuit 1A. At least one measured actual current draw may, in some embodiments, be utilized solely to determine which lighting fixture nodes are commonly powered and, in other embodiments, may additionally be used in the actual calculation of the reduced power level. In either of the immediately aforementioned scenarios, the reduced power level is based on at least one measured actual current draw.

One of ordinary skill in the art, having had the benefit of the present disclosure, will recognize that the reduced power level may be determined utilizing any of a number of methodologies and utilizing any of a number of variables in addition to at least one measured actual current draw. For example, the reduced power level may be calculated such that the cumulative power level of commonly powered lighting fixture nodes remains a predetermined amount below a maximum current capability. Also, for example, the reduced power level may be calculated based on a linear formula, non-linear formula, and/or with reference to one or more tables. Also, for example, the reduced power level may be calculated taking into account the speed of one or more fans of lighting fixture nodes 10A-D and/or one or more environmental variables such as temperature.

At step 180, controller 20 commands each of the downstream lighting fixture nodes to operate at a reduced power level. In some embodiments all of the lighting fixture nodes 10A-D on network 10 may be reduced a substantially consistent proportion below a maximum power level to thereby maintain substantially consistent optical output among the lighting fixtures of the lighting fixture nodes 10A-D. For example, the power of all of the lighting fixture nodes 10A-D may be reduced to a substantially consistent proportion such that when all the lighting fixtures thereof are being directed to operate at substantially the same light output with respect to one another, the light output among the lighting fixtures is substantially the same. Also, for example, when the lighting fixtures thereof are being directed to operate at fixed proportions to one another, the light output among the lighting fixtures is substantially at that fixed proportion. In other words, when maintaining a substantially consistent optical output among lighting fixtures when operating at a reduced power level, the directed proportionality among the lighting fixtures is substantially the same as the directed proportionality among the lighting fixtures when operating at a maximum power level (although the light output intensity of each of the lighting fixtures may be reduced).

In certain embodiments it may only be necessary and/or desirable for first lighting fixture node 10A to measure its own actual current draw to determine the number of downstream lighting fixture nodes connected thereto. For example, if lighting fixture nodes 10A-C all consume substantially the same current at their nominal power levels, then the controller 20, upon reading an actual current draw value of approximately three times the expected nominal current value across lighting fixture node 10A, may conclude that three lighting fixture nodes are connected to the first power circuit 1A. Also, if network topology has been determined, then controller 20 may, upon reading an actual current draw value of approximately the expected nominal current draw value across fourth lighting fixture node 10D, may conclude that it is the only lighting fixture node connected to the second power circuit 1D.

In some embodiments where the expected nominal current draw and the actual current draw is determined for a plurality of the lighting fixture nodes 10A-D, unexpected readings between one or more of lighting fixture nodes 10A-D may cause the network 10 to issue a system health warning to a user and/or to shutdown. For example, where comparison of actual current draw and expected nominal current draw of an upstream lighting fixture node suggests four additional lighting fixture nodes should be connected downstream of that lighting fixture node, but comparison of actual current draw and expected nominal current draw of an immediately downstream lighting fixture node suggests that only one additional fixture should be connected downstream of such immediately downstream lighting fixture node, a system health warning may be issued. The system health warning may optionally identify specific potential issues with the upstream lighting fixture node.

In some embodiments only some of the lighting fixture nodes 10A-D may be operated at a reduced power level while other of lighting fixture nodes 10A-D are operated at a non-reduced power level. In some embodiments one or more of the lighting fixture nodes 10A-D may be operated at a first reduced power level while one or more other of lighting fixture nodes 10A-D are operated at a second reduced power level distinct from the first reduced power level.

With continuing reference to FIG. 3, if at step 154 the Fixture Query Command is not received by the controller 20 (e.g., if network 10 was reconfigured such that lighting fixture node 10A is not the most upstream), the controller 20 would then assume it is a slave controller. As described herein, at step 160 the controller 20 will send an expected nominal current value to the master controller. The controller 20 may also optionally send a maximum current draw value to the master controller and/or a maximum power level value to the controller. The controller 20 may optionally send such values to the master controller after an amount of time of receiving the Fixture Query Command or may optionally send such values upon request by the master controller.

At step 162 the controller 20 operates the lighting fixture node at the nominal fixture power level. The controller 20 may do so after an amount of time, automatically upon startup (in other words, lighting fixture node may already be operating at the nominal fixture power level), or upon receipt of a command from the controller 20 (the lighting fixture may optionally power only the controller 20 [and not lighting fixture(s)] prior to receipt of a command from the controller 20).

At step 164 the controller 20 sends an actual current draw measurement to the master controller. The controller 20 may do so after an amount of time or upon receipt of a command from the controller 20.

At step 166 the controller 20 causes the driver 22 to operate at a reduced power level as dictated by the master lighting fixture node. It is understood that the reduced power level is the maximum power at which the driver will operate and that the driver may, for example during the course of a programmed show, temporarily lower the power at which it operates below the reduced power level. For example, if the maximum current which a fixture may consume when operating at reduced power level is three amps, the fixture may, during the course of a show or otherwise, operate at less than three amps.

Various methodologies may be utilized to achieve a reduced power level within a light source of a lighting fixture of lighting fixture nodes 10A-D. For example, in a first methodology the maximum output level of each color of the light source will be reduced equally. This first methodology substantially maintains color fidelity over the full range of fixture output and limits single color output intensity. Also, for example, in a second methodology the maximum output level of the light source is reduced only when multiple colors of the light source are active simultaneously. This second methodology may substantially maintain color fidelity by limiting output intensity when more than one color of a light source is active. This second methodology may also allow maximum output intensity for saturated colors. Also, for example, in a third methodology, all colors of a light source are driven at maximum output levels and the output levels are reduced only when the commanded output levels exceed the reduced power levels. In this third methodology color fidelity is sacrificed for maximum output when multiple color output configurations are active.

In some embodiments the master controller may be separately connected to the lighting fixture nodes 10A-10D and may not comprise part of a lighting fixture node. For example, in some embodiments the master controller may be enclosed in a separate housing and may be placed in network connectivity with one or more of the lighting fixture nodes 10A-D. In some embodiments all lighting fixture nodes in a network support the ability to measure actual current consumption. However, it is understood that methodologies described herein may still be effective even when only some of the lighting fixture nodes of a network support such functionality.

As described herein, in some embodiments the master controller may command all lighting fixture nodes that are in network communication with one another, including lighting fixture nodes that are not powered by a common power circuit, to operate at a substantially consistent reduced power level. However, in other embodiments where the master controller identifies network topology the master controller may command all lighting fixture nodes that are commonly powered to operate at a substantially consistent reduced power level, but may optionally command another separately powered group of lighting fixture nodes to operate at a distinct reduced power level or the maximum power level. For example, controller 20 of lighting fixture node 10A may command lighting fixture nodes 10A-C to operate at a reduced power level, but command lighting fixture node 10D to operate at a maximum power level. Also, in other embodiments the controller 20 of lighting fixture node 10A may, after identifying lighting fixture node 10D as being separately powered, enable lighting fixture node 10D to autonomously control itself (and also control one or more lighting fixture nodes that may be connected downstream of lighting fixture node 10D).

In some embodiments the network 10 may be configured such that topology of the lighting fixture nodes 10A-D may not be fully detectable. Such a situation may occur when certain bus systems are used instead of end-to-end signaling connections. In such embodiments a previously identified master controller (that may optionally be part of one of the lighting fixture nodes 10A-D) may query the actual current draw of all lighting fixture nodes 10A-D when all lighting fixture nodes 10A-D are commanded to operate at substantially similar nominal power levels. The maximum current that would be consumed by any device or by extension series of devices, is then calculated by proportional extrapolation of actual current draw across at least one of the lighting fixture nodes 10A-D. The reduced power level for each lighting fixture node is then determined based on the proportional extrapolation and transmitted to all lighting fixture nodes 10A-D.

For example, all lighting fixture nodes 10A-D may be operated at a substantially similar nominal power level of fifty percent and the actual current draw across each may be provided to a master controller. The master controller may determine that the greatest current draw communicated by any of the lighting fixture nodes is ten amps. The master controller may be aware that the lowest current rating of any of the power circuits in the network is fifteen amps. The master controller may then command all lighting fixture nodes 10A-D on the lighting fixture network to operate at a reduced power level of seventy percent to ensure that the cumulative power level of any of lighting fixture nodes connected to a common power circuit does not exceed lowest current rating of fifteen amps of the power circuits on the network.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method of selectively operating a group of networked and commonly powered lighting fixture nodes at reduced power, each of said networked lighting fixture nodes including at least one controllable lighting fixture, said method comprising:

electrically coupling a single lighting fixture node of said lighting fixture nodes to a power circuit having a power circuit maximum output;

operating each of a plurality of said lighting fixture nodes at a nominal fixture power level;

wherein each said nominal fixture power level is less than a maximum power level of a respective of said lighting fixture nodes;

identifying a current draw across at least a test lighting fixture node of said lighting fixture nodes being operated at said nominal fixture power level;

determining a reduced power level for each of said lighting fixture nodes;

wherein said reduced power level for each of said lighting fixture nodes is based at least on said current draw across said test fixture;

commanding each of said lighting fixture nodes to substantially operate at a respective said reduced power level;

wherein when said lighting fixture nodes are operating at respective said reduced power level, a substantially consistent optical output among said lighting fixture nodes is maintained; and wherein the sum of said reduced power level for all of said lighting fixture nodes is selectively bound based on said power circuit maximum output.

2. The method of claim 1, further comprising the step of determining an expected nominal current draw for at least said test lighting fixture node.

3. The method of claim 2, wherein said reduced power level is additionally based on comparing said expected nominal current draw to said current draw.

4. The method of claim 1, wherein said step of identifying said current draw across at least said test lighting fixture node further comprises individually identifying current draw across additional of said lighting fixture nodes.

5. The method of claim 4, further comprising the step of determining an expected nominal current draw for said additional of said lighting fixture nodes.

6. The method of claim 1, further comprising the step of identifying a minimum of a maximum current draw capability among said lighting fixture nodes.

7. The method of claim 6, wherein said reduced power level is selectively bound based on said minimum of said maximum current draw capability.

8. The method of claim 1, wherein said reduced power level is based on proportional extrapolation of said current draw across said test lighting fixture node.

9. The method of claim 8, wherein said test lighting fixture node is directly electrically coupled to said power circuit.

10. A method of selectively operating a group of networked and commonly powered lighting fixture nodes at reduced power, each of said networked lighting fixture nodes including at least one controllable lighting fixture, said method comprising:

electrically coupling a single lighting fixture node of said lighting fixture nodes to a power circuit having a power circuit maximum output;

broadcasting a query fixture network topology command to all of said lighting fixture nodes;

wherein each of said lighting fixture nodes sends a fixture query command to at least one of any downstream of said lighting fixture nodes after receipt of said query fixture network topology command;

determining a master lighting fixture node of said lighting fixture nodes which did not receive any said fixture query command;

determining an expected nominal current of at least one fixture of said lighting fixture nodes;

operating said one lighting fixture node and any of said lighting fixture nodes downstream from said one lighting fixture node at a nominal fixture power level that is less than a maximum power level of a respective of said lighting fixture nodes;

identifying a current draw across at least said one lighting fixture node when said one lighting fixture node and any of said lighting fixture nodes downstream from said one lighting fixture node are being operated at said nominal fixture power level;

reducing power consumption of at least some of said lighting fixture nodes based at least in part on comparing said expected nominal current draw to said current draw.

11. The method of claim 10, wherein the step of reducing power consumption of at least some of said lighting fixture nodes comprises reducing power consumption of at least some of said lighting fixture nodes such that a substantially consistent optical output is maintained therebetween.

12. The method of claim 11, wherein the step of reducing power consumption of at least some of said lighting fixture nodes comprises reducing power consumption of all of said lighting fixture nodes.

13. The method of claim 10, wherein said one lighting fixture node is said master lighting fixture node.

14. The method of claim 10, wherein each of said lighting fixture nodes sends said fixture query command to only an immediately downstream of said lighting fixture nodes upon receipt of said query fixture network topology command.

15. The method of claim 10, wherein the step of determining an expected nominal current of at least said one lighting fixture node of said lighting fixture nodes comprises determining an expected nominal current of additional of said lighting fixture nodes and wherein the step of identifying current draw across at least said one lighting fixture node further comprises individually identifying current draw across said additional of said lighting fixture nodes.

16. The method of claim 10, further comprising the step of identifying a first separately powered lighting fixture node in a separate group of commonly networked but separately powered lighting fixture nodes by comparing said expected nominal current and said actual nominal current of said first separately powered lighting fixture node to said expected nominal current and said actual nominal current of at least one of said lighting fixture nodes.

17. The method of claim 10, further comprising the steps of identifying a minimum of a maximum current draw capability among said lighting fixture nodes and selectively bounding said reduced power level based on said minimum of said maximum current draw capability.

18. A lighting fixture network, comprising:

a plurality of lighting fixture nodes in communication with one another, each of said lighting fixture nodes comprising:

at least one lighting fixture having at least one light source;

at least one adjustable driver driving said at least one light source at a selectively adjustable power level;

a controller in communication with said adjustable driver;

a communication system in communication with said controller and in communication with at least one other of said lighting fixture nodes;

a power input receiving power directly from at least one of other of said lighting fixture nodes and a power circuit; and a power output for selectively transmitting power to at least one other of said lighting fixture nodes;

wherein each said controller is operable in a power level determination mode;

wherein in said power level determination mode each said controller causes a corresponding said driver to operate at a nominal fixture power level;

wherein each said nominal fixture power level is less than a maximum power level of a respective of said driver; and wherein at least one said controller selectively communicates expected current draw data to at least one other of said lighting fixture nodes and selectively communicates actual current draw data from operation in said power level determination mode to at least one other of said lighting fixture nodes;

wherein each said controller is operable in a reduced power mode;

wherein in said reduced power mode each said controller causes a corresponding said driver to operate at a reduced power level; and wherein each said reduced power level is based at least in part on comparing said expected nominal current draw to said current draw.

19. The lighting fixture network of claim 18, wherein when in said reduced power mode, each of said controllers causes a corresponding said driver to drive a corresponding said at least one light source such that a substantially consistent optical output among said lighting fixture nodes is maintained.

20. The lighting fixture network of claim 18, wherein in said power level determination mode a plurality of said controller 20 selectively communicate a respective said expected current draw data to at least one other of said lighting fixture nodes and selectively communicate a respective said actual current draw data to at least one other of said lighting fixture nodes.

21. The lighting fixture network of claim 20, wherein each said reduced power level is based at least in part on comparing a plurality of said expected nominal current draw to a plurality of said actual current draw.

* * * * *